US009239139B2

(12) United States Patent
McCauley

(10) Patent No.: US 9,239,139 B2
(45) Date of Patent: Jan. 19, 2016

(54) METHOD FOR DECORATING AN EXTERIOR LIGHT FIXTURE

(76) Inventor: Mark C. McCauley, Delray Beach, FL (US)

( * ) Notice: Subject to any disclaimer, the term of this patent is extended or adjusted under 35 U.S.C. 154(b) by 1158 days.

(21) Appl. No.: 12/638,669

(22) Filed: Dec. 15, 2009

(65) Prior Publication Data

US 2010/0088878 A1 Apr. 15, 2010

Related U.S. Application Data

(63) Continuation-in-part of application No. 11/860,574, filed on Sep. 25, 2007, now Pat. No. 7,658,516.

(51) Int. Cl.
*F21V 11/00* (2015.01)
*F21K 99/00* (2010.01)

(52) U.S. Cl.
CPC .... *F21K 9/56* (2013.01); *F21K 9/50* (2013.01)

(58) Field of Classification Search
CPC ..... F21K 9/56; F21K 9/50; F21Y 2101/02
USPC ..... 362/351, 808, 153.1, 311, 257, 362, 362/363, 433, 457, 458, 806, 807, 809; 29/505
See application file for complete search history.

(56) References Cited

U.S. PATENT DOCUMENTS 2,816,378 A 12/1957 Levinson
4,833,580 A 5/1989 Allen
5,051,879 A * 9/1991 Bunger ..... 362/351
5,567,045 A 10/1996 Bucek
5,772,312 A * 6/1998 Pihl-Niederman et al. ..... 362/249.08
6,561,682 B1 * 5/2003 Juang ..... 362/352
6,575,591 B1 * 6/2003 De Lany ..... 362/153
6,629,770 B2 10/2003 Blatherwick
6,705,743 B1 3/2004 Elembaby et al.
6,902,297 B1 6/2005 Fung
7,156,537 B1 1/2007 Cohrs
7,399,091 B2 * 7/2008 Lockett et al. ..... 353/120
2001/0036073 A1 11/2001 Trease
2007/0189020 A1 * 8/2007 Chen et al. ..... 362/362

* cited by examiner

*Primary Examiner* — Anh Mai
*Assistant Examiner* — Jessica M Apenteng
(74) *Attorney, Agent, or Firm* — The Concept Law Group, P.A.; Scott D. Smiley; Mark C. Johnson

(57) ABSTRACT

A method for decorating an exterior light fixture includes the step of providing a decorative body with an ornamental design corresponding to a single event, where the decorative body has a rear side with an elastically deformable couple and a front side with the ornamental design. The method also includes the step of elastically deforming at least a part of the rear side to removably attach the decorative body to an exterior light fixture that is attached to an exterior surface of a building structure such that the ornamental design is positioned on a side of the light fixture opposite the structure. The ornamental design and at least a portion of the body surrounding the ornamental design have differing translucences such that light emitted from the light fixture enhances visibility of the ornamental design from a distance away from the body.

20 Claims, 4 Drawing Sheets

PRIOR ART

METHOD FOR DECORATING AN EXTERIOR LIGHT FIXTURE

CROSS-REFERENCE TO RELATED APPLICATION

This application is a continuation in part of U.S. patent application Ser. No. 11/860,574, filed Sep. 25, 2007 the entire disclosure of which is all hereby incorporated herein by reference in their entireties.

FIELD OF THE INVENTION

The present invention relates generally to holiday decorations, and more particularly relates to a sleeve with a holiday or special event-related pattern that fits over an exterior light attached to a building.

BACKGROUND OF THE INVENTION

Exterior light fixtures, such as light 100 shown in FIG. 1, are well known. The light 100 is of the type found on many homes 102 in a typical neighborhood. The light 100 has a light bulb 104 and power is fed to the bulb 104 though a conductor 106 that is connected to a remote power source within the house 102. Although the style of the light 100 varies from home to home, the purpose is consistent—to provide light to the front of the structure 102. In most instances, the light fixture 100 can be seen from the street and has a decorative effect.

Many people enjoy expressing themselves on special occasions, such as the Fourth of July, Halloween, Christmas, birthday parties, baby showers, and many others. This expression is often in the form of, for example, signs, banners, objects in the yard, and internally-lighted ornaments. Internally-lighted ornaments can be, for example, a pumpkin with a light bulb inside, a plastic snowman with a light bulb inside, or other similar devices. However, the light bulbs must receive power from a power source. This requires a user to install the ornament somewhere in the front of their house and to run an electrical conductor to a receptacle that supplies power to the ornament. If the receptacle is not close to the ornament, a long conductor, such as an extension cord, is required. The extension cord is vulnerable to tripping people and presents an electrical hazard. If no receptacle is available on the exterior of the house, the electrical conductor must be run to the interior of the structure, which may prevent a window or door from being able to be shut securely. This renders the home vulnerable to break-ins and theft. In addition, setting up and powering the ornament takes time and effort. Furthermore, free-standing ornaments are susceptible to falling over in high winds.

Therefore, a need exists to overcome the problems with the prior art as discussed above.

SUMMARY OF THE INVENTION

Briefly, in accordance with the present invention, disclosed a method for decorating an exterior light fixture, which includes the step of providing a decorative body with an ornamental design corresponding to a single event, where the decorative body has a rear side with an elastically deformable couple and a front side with the ornamental design. The method also includes the step of elastically deforming at least a part of the rear side to removably attach the decorative body to an exterior light fixture that is attached to an exterior surface of a building structure such that the ornamental design is positioned on a side of the light fixture opposite the structure. The ornamental design and at least a portion of the body surrounding the ornamental design have differing translucences such that light emitted from the light fixture enhances visibility of the ornamental design from a distance away from the body.

In accordance with another feature of the present invention, the elastically deforming step includes manipulating a fastener coupled from a first side of the body to a second side of the body so that the fastener, together with the body, surrounds the light fixture.

In accordance with a further feature of the present invention, the elastically deforming step includes expanding an opening in the rear side from a closed position in which the body has a natural resting shape to an open position in which a portion of the body is flexibly deformed from the natural resting shape.

In accordance with yet another feature of the present invention, the body includes an interior void for receiving therein the exterior light fixture and an exterior surrounding the void and having the ornamental design.

In accordance with an additional feature of the present invention, the removably attaching step includes inserting the light fixture into the interior void.

In accordance with an additional feature of the present invention, the body includes a bottom portion and a structure support portion at the bottom portion, the structure support portion shaped to support and balance the body on the light source when inserted within the interior.

In accordance with a further embodiment of the present invention, disclosed is a light cover that includes a body defining an interior void for receiving a light source affixed to a structure. An opening in a first portion of the body has a closed position and an open position in which the light source can be inserted into the interior of the body. A structure support portion at the opening is shaped to support and balance the body on the light source when the light source is inserted within the interior. A second portion of the body has an ornamental design, wherein the ornamental design and at least a portion of the body surrounding the ornamental design has differing translucences such that light emitted from the void enhances visibility of the ornamental design from outside the skin.

In accordance with another feature, an embodiment of the present invention includes fastener that is attached to on opening on the body and selectively couples a first side of the opening to a second side.

In accordance with a further feature of the present invention, the ornamental design is at least partially defined by recessed areas in the body.

In accordance with yet another feature of the present invention, the ornamental design is a holiday-related image, a holiday-related shape, and/or text.

In accordance with an additional feature of the present invention, the shape is at least one of curved, square, and a holiday figure.

In accordance with a further feature, the present invention includes a skin that has a closable opening for accepting a light source into an interior portion of the skin and adhering to the light source, a decorative portion, and a translucence allowing light to pass from the light source, through the skin, and away from the skin.

In accordance with another feature, an embodiment of the present invention also includes a cover for covering an exterior lamp attached to a building, where the cover includes a skin having a holiday-related design, a shape defining a lamp-holding void, an opening fluidically connected to the void when in an open position, a clasping mechanism operable for holding the opening in a closed position, and a translucence for allowing light to pass from the light source, through the skin, and away from the skin.

BRIEF DESCRIPTION OF THE DRAWINGS

The accompanying figures, where like reference numerals refer to identical or functionally similar elements throughout the separate views and which, together with the detailed description below, are incorporated in and form part of the specification, serve to further illustrate various embodiments and to explain various principles and advantages all in accordance with the present invention.

DETAILED DESCRIPTION

Figure 1:
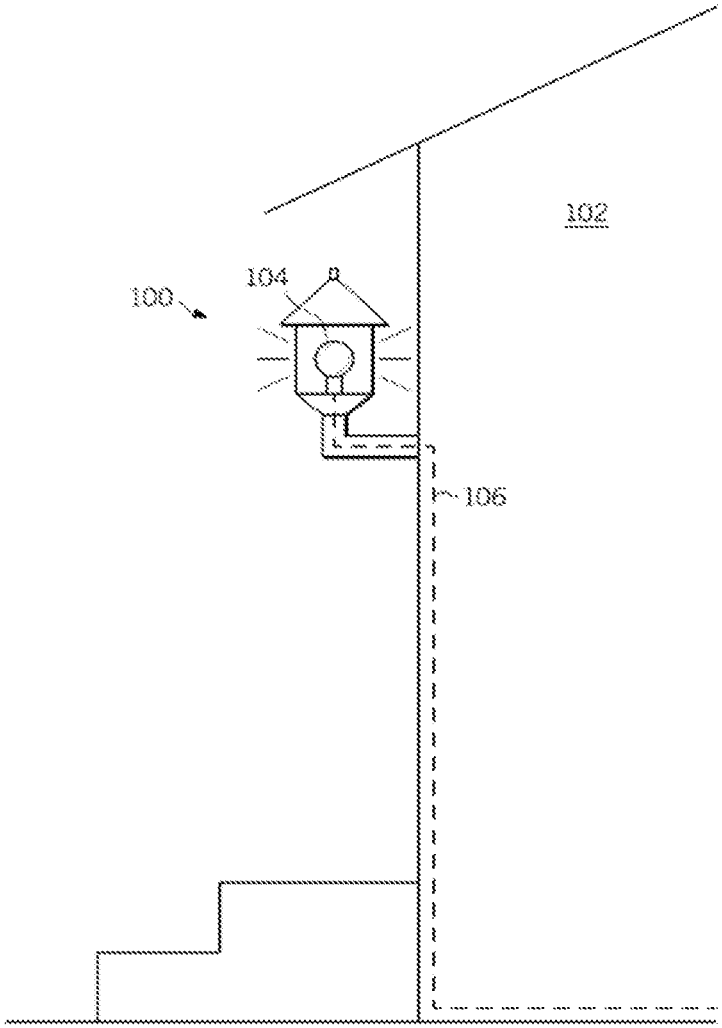
FIG. 1 is a fragmentary, side elevational view of a building structure with a fixed prior art external light source.

While the specification concludes with claims defining the features of the invention that are regarded as novel, it is believed that the invention will be better understood from a consideration of the following description in conjunction with the drawing figures, in which like reference numerals are carried forward. It is to be understood that the disclosed embodiments are merely exemplary of the invention, which can be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure. Further, the terms and phrases used herein are not intended to be limiting, but rather, to provide an understandable description of the invention.

The terms "a" or "an," as used herein, are defined as one or more than one. The term "plurality," as used herein, is defined as two or more than two. The term "another," as used herein, is defined as at least a second or more. The terms "including" and/or "having," as used herein, are defined as comprising (i.e., open language). The term "coupled," as used herein, is defined as connected, although not necessarily directly, and not necessarily mechanically.

The present invention provides a novel decorative lamp covering that easily slips onto existing exterior lighting fixtures attached to building structures and provides a visually stimulating and pleasant effect. The invention can be provided in many embodiments, allowing a user to express him or herself for virtually any special event or occasion.

Figure 2:
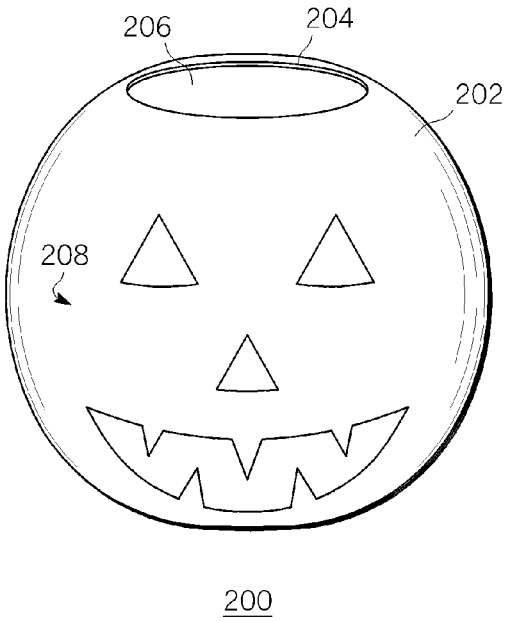
FIG. 2 is a perspective view of a decorative skin in accordance with the present invention.

Referring now to FIG. 2, one embodiment of the present invention is shown. FIG. 2 illustrates several advantageous features of the present invention, but, as will be described below, the invention can be provided in several shapes, sizes, combinations of features and components, and varying numbers and functions of the components. In this first embodiment of FIG. 2, the inventive decorative cover 200 includes a substantially rigid skin 202 that is shaped with a curve 204 that defines a void 206 within an interior of the skin 202. As used herein, substantially rigid or semi-rigid means retaining its shape under normal forces (i.e., slight bending or flexing by hand) and outdoor temperatures (e.g., −10 to 105 degrees Fahrenheit). The decorative cover 200 has an ornamental design 208 on a portion of the skin 202, in this case, a jack-o-lantern face. In one embodiment, the skin 202 is a semi-rigid plastic material that is inexpensive to make, light weight, and durable. The skin 202, however, can be made of any material that is suitable for attachment to a light fixture. The skin 202 can have a translucent quality that allows light to pass from the light source 100, through the skin 202, and away from the skin 202, where it can be seen by viewers a distance away. Many plastics, if provided in sufficiently thin dimensions, provide this translucence. Other material may also be used. In one embodiment, the translucent attribute allows a light source to illuminate all portions of the cover 200 except for the design 208, which is opaque or otherwise has a translucence that differs from that of the rest of the cover 200. In other embodiments, only the design is translucent and the rest of the cover is opaque.

Figure 3:
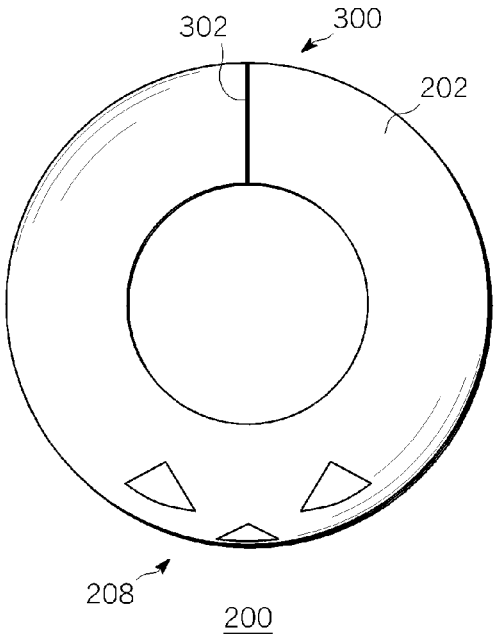
FIG. 3 is a top plan view of the decorative skin of FIG. 2 in a closed/secured position.
Figure 4:
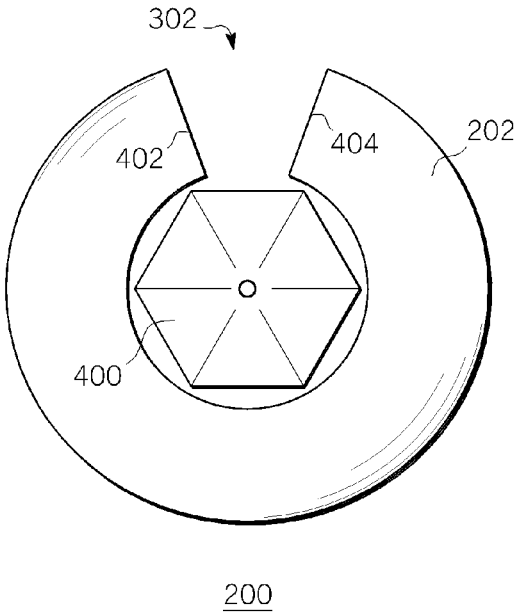
FIG. 4 is a top plan view of the decorative skin of FIG. 3 in a partially opened position.

As shown in the top view of FIG. 3, one side 300 of the skin 200 has an opening 302 that will allow the cover 200 to be placed onto a lamp. The opening 302, in one embodiment, is simply a separation, or discontinuity, of the skin 202, where the material, e.g., of plastic, is able to separate. If the material is semi-rigid, the opening 302 can be placed in the open position, as shown in FIG. 4, by temporarily deforming, bending, or flexing the skin 202 to separate two sides 402 and 404 of the opening 302. Once the two sides 402 and 404 of the skin 202 are separated, the cover 200 can be placed around a light fixture 400 and allowed to return to its steady state closed position, as shown in FIG. 3.

Once around the light fixture 400, the skin 202 is rigid enough to adhere to the fixture 400 and retain its original shape, for example, as shown in FIGS. 2 and 3. As stated above, once the cover 200 is around the light fixture 400, and the light fixture 400 is on and radiating light, the cover 200, in one embodiment, is of an at least partially translucent material that is able to receive light from the light-radiating portion (bulb) of the light fixture 400 and allow the light to pass through and project away from the skin 202. The translucent attribute of the skin 202 allows the decorative cover to be visible at night from a distance and will allow the ornamental design 208 to be easily seen. Providing the skin material 202 in a variety of colors provides multiple visual choices.

Figure 5:
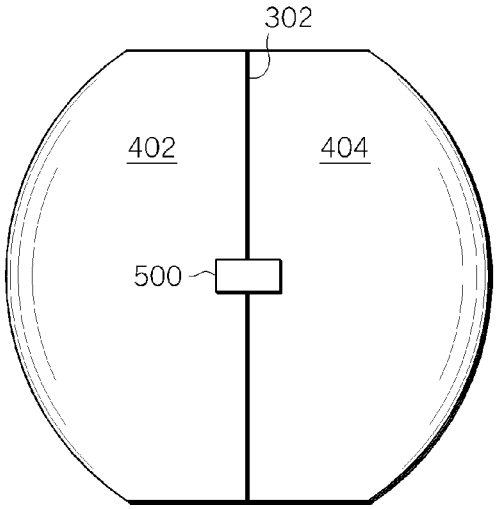
FIG. 5 is a rear elevational view of the skin of FIG. 3 in the closed position with a clasp holding the skin closed.

FIG. 5 is an elevational rear view of the decorative cover 200 showing the opening 302 in a closed position. In this exemplary embodiment, a fastener 500 is attached to one or both of the sides 402 and 404 of the opening 302 and is able to couple one of the sides 402 of the opening 302 to the other side 404 of the opening 302. The fastener 500 can be one or more snaps, VELCRO, hooks, tape, an interlocking mechanism, a combination thereof, or many more.

Figure 6:
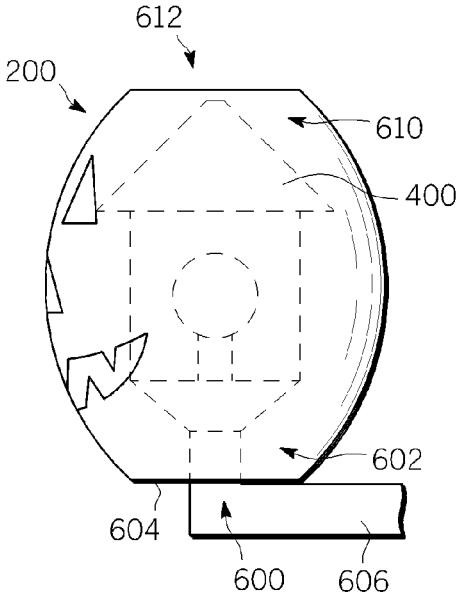
FIG. 6 is an elevational side view of the skin of FIG. 2 attached to the light source of FIG. 1 in accordance with an exemplary embodiment of the present invention.

FIG. 6 shows an elevational side view of the present invention 200 attached to an exterior light fixture 400. As can be seen in this view, the decorative cover 200 has an opening 600 at a bottom end 602 thereof. An edge 604 of the opening 600 presents a structure support portion of the cover 200 and rests against an attachment post 606 of the light fixture 400 and supports the cover 200 in its balanced position on and around the light fixture 400. In one embodiment of the present invention, the decorative cover 200 does not have an opening along the back side 608. In this embodiment, the cover 200 can be attached to the light fixture 400 by sliding the opening 600 in the bottom end 602 of the cover 200 over the lamp fixture 400. If the opening 600 is sufficiently large, it will easily slide over the lamp 400. If desired, the lower extremity can be made of a material that expands to stretch over the lamp fixture 400.

The top portion 610 can also have an opening 612. The opening 612 advantageously allows heat to escape and reduces the likelihood that the cover 200 will melt or otherwise be damaged by the heat. In other embodiments, there is no opening in the top portion 610.

Although an exemplary embodiment of the present invention 200 attaches to an exterior light fixture 400 which is, itself, attached to an exterior surface of the building structure 102, the present invention can also attach to a free standing light post set a distance away from the house 102. Quite common on residential and business properties, free standing light posts are installed directly in the ground away from the building structure 102 in order to illuminate the area, such as a yard or driveway. The ground may include, but is not limited to, soil, concrete, gravel, grass, pavers, and the like. Free standing light posts attach to the ground by connecting the base of the post to the ground, i.e., Earth, or by digging a hole in the ground to permanently affix the post. By using the fastener 500, the present invention 200 can attach to free standing light posts in the ground, not only exterior light fixtures 400.

Similar to the way the Earth creates an electrical "ground" that would couple the building structure 102 to the free standing light post, the ground can also couples objects physically. In the case of a free standing light post, the light post is mechanically fixedly coupled to the building structure 102 through the ground (earth) upon which both are supported.

Figure 7:
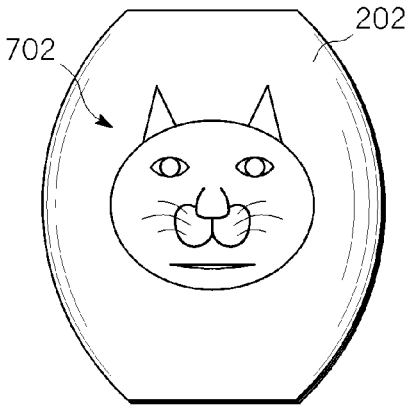
FIG. 7 is an elevational front view of another exemplary embodiment of a skin in accordance with the present invention with a decoration thereon.
Figure 8:
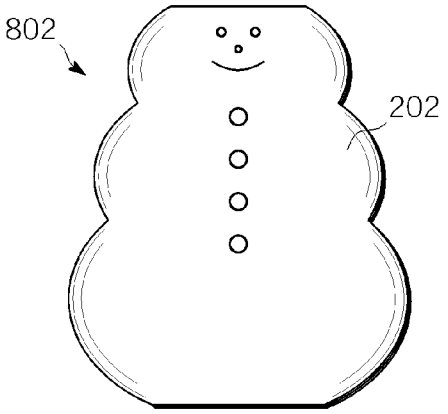
FIG. 8 is an elevational front view of a further exemplary embodiment of a skin in accordance with the present invention having an exterior shape.
Figure 9:
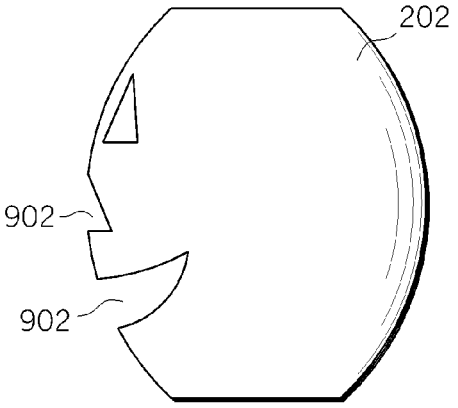
FIG. 9 is an elevational side view of yet another exemplary embodiment of a skin in accordance with the present invention with indentions forming a decoration.
Figure 10:
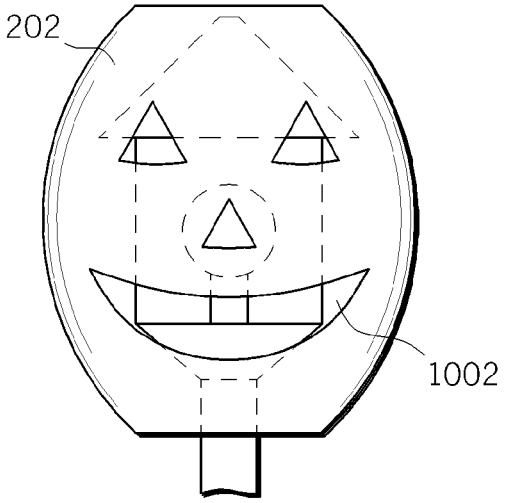
FIG. 10 is a partially hidden and elevational front view of still another exemplary embodiment of a skin in accordance with the present invention with a decoration formed by removing portions of the skin.
Figure 11:
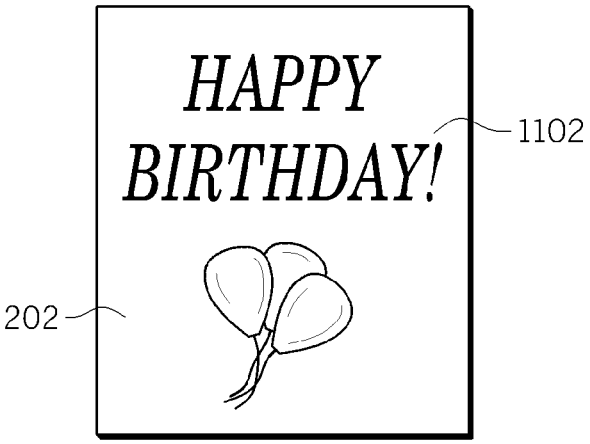
FIG. 11 is an elevational front view of another exemplary embodiment of a skin in accordance with the present invention with a partially textual decoration thereon.

FIGS. 7-11 show several examples of alternative ornamental designs that can be placed on the skin 202 of the cover 200. The design can be drawn 702 onto the skin 202, as shown in FIG. 7, or, as shown in FIG. 8, can be an exterior shape 802 of the cover 200. In the shaped embodiments, the skin can be shaped as a holiday figure, such as a snowman (shown in FIG. 8), an Easter bunny, a birthday present, and many others. The design can also be, as shown in FIG. 9, indentions 902 into the skin material 202 or, as shown in FIG. 10, removed portions 1002 of the skin material 202. The ornamental design does not have to be a shape, but can instead or additionally, be text 1102 placed on the cover 200, as shown in FIG. 11.

A decorative cover has been disclosed that easily slides onto or over a light fixture and produces a decorative effect that allows self-expression or that reminds others of holidays and/or other special events. The decorative cover is easy to install and remove and, advantageously, does not require the installation of additional electrical wires or a separate power source.

What is claimed is:

1. A method for decorating an exterior light fixture, the method comprising:

providing a decorative body with an ornamental design corresponding to a single event, the decorative body having a rear side with an elastically deformable couple and a substantially rigid front side with the ornamental design, the elastically deformable couple having two opposing ends and is of a material different than a material of the decorative body; and elastically deforming the couple with each of the opposing ends attached to the decorative body to maintain a coupling relationship between the decorative body and both opposing ends of the couple, at least a part of the rear side to removably attach the decorative body to an exterior light fixture that is mechanically fixedly coupled to a building structure such that the ornamental design is positioned on a side of the light fixture opposite the building structure, wherein the ornamental design and at least a portion of the body surrounding the ornamental design have differing translucences such that light emitted from the light fixture enhances visibility of the ornamental design from a distance away from the body.

2. The method according to claim 1, wherein elastically deforming comprises:

manipulating a fastener coupled from a first side of the body to a second side of the body so that the fastener, together with the body, surrounds the light fixture.

3. The method according to claim 1, wherein elastically deforming comprises:

expanding an opening in the rear side from a closed position in which the body has a natural resting shape to an open position in which a portion of the body is flexibly deformed from the natural resting shape.

4. The method according to claim 3, wherein the body comprises:

an interior void for receiving therein the exterior light fixture; and an exterior surrounding the interior void and having the ornamental design.

5. The method according to claim 4, wherein the removably attaching comprises:

inserting the light fixture into the interior void.

6. The method according to claim 1, wherein the body comprises:

a bottom portion; and a structure support portion at the bottom portion, the structure support portion shaped to support and balance the body on the light fixture when inserted within the interior.

7. The method according to claim 1, wherein:

the body is at least partially plastic.

8. The method according to claim 1, wherein:

the exterior fixture is attached to an exterior surface of the building structure.

9. The method according to claim 1, wherein the ornamental design comprises at least one of:

a holiday-related image;

a holiday-related shape;

a sports-related image; and a sports-related shape.

10. The method according to claim 1, wherein the ornamental design comprises text.

11. A method for decorating an exterior light fixture, the method comprising:

providing a decorative body with an ornamental design corresponding to a single event, the decorative body having a flexible rear side defining a discontinuous opening and a substantially rigid front side with the ornamental design; and elastically deforming at least a part of the rear side to separate the discontinuous opening, with the rear side still coupled to one another, and removably install the decorative body on an exterior light fixture that is attached to an exterior surface of a building structure such that the ornamental design is positioned on a side of the light fixture opposite the building structure, wherein the ornamental design and at least a portion of the body surrounding the ornamental design have differing translucences such that light emitted from the light fixture enhances visibility of the ornamental design from a distance away from the body.

12. The method according to claim 11, wherein elastically deforming comprises:

manipulating a fastener coupled from a first side of the body to a second side of the body so that the fastener, together with the body, surrounds the light fixture.

13. The method according to claim 11, wherein elastically deforming comprises:

expanding an opening in the rear side from a closed position in which the body has a natural resting shape to an open position in which a portion of the body is flexibly deformed from the natural resting shape.

14. The method according to claim 13, wherein the body comprises:

an interior void for receiving therein the exterior light fixture; and an exterior surrounding the interior void and having the ornamental design.

15. The method according to claim 14, wherein the removably attaching comprises:

inserting the light fixture into the interior void.

16. The method according to claim 11, wherein the ornamental design comprises at least one of:

a holiday-related image;

a holiday-related shape;

a sports-related image; and a sports-related shape.

17. A method for decorating an exterior light fixture, the method comprising:

providing a decorative body with an ornamental design corresponding to a single event, the decorative body having a rear side with an elastically deformable couple, an opening in the rear side of the decorative body defined by a first side and a second side of the decorative body, and a substantially rigid front side with the ornamental design, the elastically deformable couple having one end fastened to the first side of the decorative body and having a second end fastened to the second side of the decorative body, the first and second ends of the couple spanning over an opening defined by the rear side; and elastically deforming the couple, with the first and second ends of the couple still fastened to the decorative body, to separate the first and second sides of the decorative body to removably install the decorative body on an exterior light fixture that is attached to an exterior surface of a building structure such that the ornamental design is positioned on a side of the light fixture opposite the building structure, wherein the ornamental design and at least a portion of the body surrounding the ornamental design have differing translucences such that light emitted from the light fixture enhances visibility of the ornamental design from a distance away from the body.

18. The method according to claim 17, wherein elastically deforming comprises:

manipulating a fastener coupled from a first side of the body to a second side of the body so that the fastener, together with the body, surrounds the light fixture.

19. The method according to claim 17, wherein elastically deforming comprises:

expanding an opening in the rear side from a closed position in which the body has a natural resting shape to an open position in which a portion of the body is flexibly deformed from the natural resting shape.

20. The method according to claim 19, wherein the body comprises:

an interior void for receiving therein the exterior light fixture; and an exterior surrounding the interior void and having the ornamental design.

* * * * *